United States Patent [19]

Lee

[11] Patent Number: 4,841,372

[45] **Date of Patent: * Jun. 20, 1989**

[54] CATHODE RAY TUBE CONTRAST ENHANCEMENT SYSTEMS

[75] Inventor: Sae D. Lee, Buffalo Grove, Ill.

[73] Assignee: Zenith Electronics Corporation, Glenview, Ill.

[ * ] Notice: The portion of the term of this patent subsequent to Apr. 19, 2005 has been disclaimed.

[21] Appl. No.: 941,458

[22] Filed: Dec. 15, 1986

Related U.S. Application Data

[63] Continuation-in-part of Ser. No. 894,984, Aug. 8, 1986.

[51] Int. Cl.[4] ..... H01J 29/87

[52] U.S. Cl. ..... 358/247; 445/8; 358/252

[58] Field of Search ..... 445/8, 45; 358/247, 358/252, 253; 156/275.5, 275.7; 220/2.1 A

[56] References Cited

U.S. PATENT DOCUMENTS

| | | | |
|---|---|---|---|
| 2,734,142 | 2/1956 | Barnes | 313/92 |
| 3,164,672 | 1/1965 | Spear et al. | 358/247 |
| 3,708,622 | 1/1973 | Brown, Jr. et al. | 358/247 |
| 3,879,627 | 4/1975 | Robinder | 313/112 |
| 3,909,524 | 9/1975 | Ohkoshi et al. | 358/347 |
| 4,191,725 | 3/1980 | Armstrong et al. | 358/252 X |
| 4,272,589 | 6/1981 | Dubois et al. | 156/275.5 |
| 4,329,620 | 5/1982 | Lanciano | 358/247 |
| 4,355,077 | 10/1982 | Chevreux | 156/275.5 |
| 4,643,785 | 2/1987 | Paynton | 156/275.5 |

FOREIGN PATENT DOCUMENTS

| | | | |
|---|---|---|---|
| 96637 | 6/1984 | Japan | 445/45 |
| 889457 | 2/1962 | United Kingdom . | |

*Primary Examiner*—Kenneth J. Ramsey

[57] ABSTRACT

A resin bonding system which bonds a substantially flat implosion protection panel to the nominally flat faceplate of a flat tension mask CRT tube and is cured by exposure to ultraviolet radiation. The resin bonding system is designed for differential adhesion so that the faceplate separates more easily from the resin than does the implosion protection panel, thus achieving superior implosion performance. It also incorporates a contrast-enhancing neutral density agent, preferably confined to a flat layer adjacent to and adhered to the flat surface of the implosion panel in order to achieve uniform neutral density filtration across the face of the tube. The neutral density agent is preferably an organic dye. Because the nominally flat faceplate is actually somewhat concave after evacuation of the tube, confining the neutral density agent to the layer which adheres to the flat faceplate avoids mottling of the CRT picture which would otherwise result from changes in the thickness of the pigmented layer across the face of the CRT.

29 Claims, 1 Drawing Sheet

FIG. 1
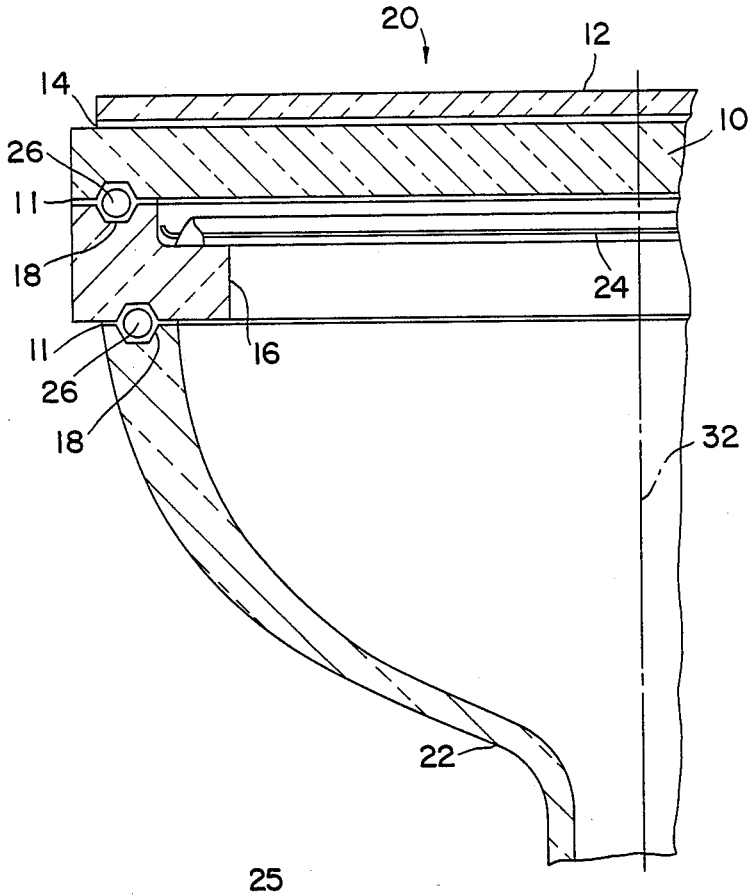
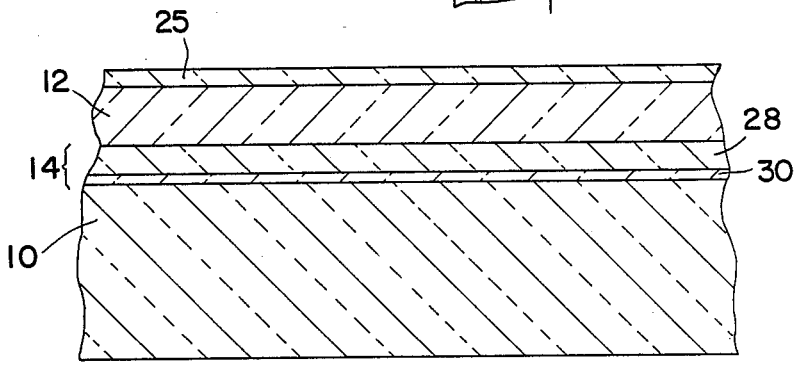
FIG. 2

CATHODE RAY TUBE CONTRAST ENHANCEMENT SYSTEMS

RELATED APPLICATION

This application is a continuation-in-part of my U.S. application Ser. No. 894,984, filed 8/8/86, entitled "Cathode Ray Tube Implosion Protection System."

FIELD OF THE INVENTION

The invention relates to methods and means for enhancing the image quality of a cathode ray tube.

BACKGROUND OF THE INVENTION

The implosion which occurs upon breakage of the envelope of an evacuated cathode ray tube (CRT) is quite dangerous. Impact on the glass faceplate of such a tube can cause the faceplate to shatter into many fragments, which may be violently driven into the interior of the tube by external air pressure. The glass fragments then rebound outwardly and are ejected with sufficient force to cause serious injury to a person standing in front of the tube.

Until recently, all color television tubes have consisted of CRT's with convexly curved faceplates. Such faceplates resist external air pressure in much the same manner as an arch supports an architectural load, and for that reason prior art methods of implosion protection have proved adequate. But curved faceplates require that the shadow mask employed in color TV systems must also be curved. Recently, a superior color CRT has been invented which employs a flat, tensioned shadow mask and a flat faceplate, and this has resulted in a major improvement in the brightness and/or contrast of the color image.

Unfortunately the implosion protection systems which have been used successfully with curved faceplate tubes have proven inadequate when used with flat faceplates. In particular, when prior art implosion protection systems are tested on the new flat tension mask tubes, they fail to meet UL1418, the relevant safety standard of Underwriters Laboratories, Inc. for television implosion hazards.

A new type of implosion protection, system however, has now been developed and is disclosed in the parent application cited above. That system employs a UV-curable resin formulation to bond an implosion panel to a CRT faceplate, the formulation being designed to achieve separation of the implosion panel from the faceplate upon impact.

The present invention is an improvement upon the above-described resin system, in that a contrast enhancement agent is added to the resin portion of the implosion protection system in order to improve the quality of the CRT image.

It is also an improvement upon contrast-enhancement systems of the type suggested in Robinder, U.S. Pat. No. 3,879,627; in which colloidal carbon or graphite is added as a neutral density filtration agent to an epoxy or polyester adhesive resin layer which bonds an implosion panel to a CRT faceplate. Column 3, lines 55–64 of that patent explain why neutral density filtration enhances CRT image contrast.

See also Ohkoshi, U.S. Pat. No., 3,909,524; in which a black "paint" such as carbon or silica is added as an optical filtering agent to a polyester adhesive resin layer which bonds an implosion panel to a CRT faceplate.

A contrast-enhancing neutral density filtration effect, combined with implosion protection, is also claimed by Barnes, U.S. Pat. No. 2,734,142; in which a sheet of cellulosic or other plastic material, treated with amino hydroquinone diethyl ether and a copper salt, is inserted between an external lens and a CRT faceplate.

Then there is British specification 889,457 of Darlaston et al.; which coats a CRT faceplate externally with layers of polymeric material for implosion protection, and adds an unspecified dye or pigment to the polymer for image enhancement purposes.

The above-described prior art, however, does not employ the type of neutral density filtration agent taught herein, nor does it disclose a method of preparing a UV-curable resin bonding system incorporating such a filtration agent. It also does not address the special case of neutral density filtration in the environment of the new flat tension mask type of CRT tube.

A preferred contrast-enhancing agent is one which will be uniformly distributed throughout the adhesive resin. When carbon particles and similar colloidal dispersions were used, it was not possible to obtain homogeneous distribution of the particles throughout the resin, and therefore the picture tube lacked the uniform appearance desired. The preferred contrast-enhancing agents are those which are organic and are soluble in an organic solvent, which in turn is soluble in and chemically reactive with the adhesive resin system. The best organic contrast-enhancing agents are generally the mono-azo metal complex dyestuffs. The specific material used here as an example is "Orasol Black CN" from Ciba-Geigy Corp., a material which has the following C.I. number in the publication "Colour Index:" C.I. Solvent Black 28.

Preferred embodiments demonstrating the various objectives and features of the invention will now be described in conjunction with the following drawings, which constitute a part of this specification:

BRIEF DESCRIPTION OF THE DRAWINGS

FIG. 1 is a partial longitudinal cross-sectional view of a flat tension mask cathode ray tube having an implosion panel system with a contrast enhancement agent in accordance with this invention;

FIG. 2 is an enlarged cross-sectional detail view of the same tube illustrating one embodiment of a contrast-enhancing resin bonding system in accordance with this invention.

DETAILED DESCRIPTION OF THE PREFERRED EMBODIMENTS OF THE INVENTION

Referring to FIG. 1, an evacuated CRT tube 20 comprises a funnel 22, frame 16 and flat faceplate 10 all made of glass. A flat, tensioned color shadow mask 24 is mounted on the frame 16 within the evacuated envelope. Funnel 22 is sealed to frame 16 by means of glass frit in the circumferential sealing area 11 and in the registry grooves 18 which contain a plurality of registry balls 26. Faceplate 10 is sealed to the frame 16 in the identical fashion. A glass implosion panel 12 is bonded to the external surface of faceplate 10 by means of a resin system 14. Implosion panel 12 is substantially thinner and more flexible than the faceplate 10. The implosion panel is commercial double strength window glass with a thickness of an eighth of an inch. The window glass is coated with a thin layer of an anti-reflection material 25 on its outer surface. See FIG. 2.

The preferred embodiment of the resin system 14 has two resin layers 28 and 30 which are different compositions with different adhesive properties. The outer resin layer 28 adheres tightly to the implosion panel 12, and preferably has a thickness in the range from twenty to forty mils. The inner resin layer 30 adheres to the faceplate 10 and adheres weakly to the outer layer 28. The inner layer 30 has a thickness that may vary from 5–15 mils across the face of the tube 20, since the faceplate 10 generally has a slightly concave surface due to the internal vacuum of the CRT.

The resin layers must have a thermal stability sufficient to exceed U.L. standards (which require that laminated tubes withstand 149 degrees Celsius for 50 hours and 154 degrees Celsius for 40 hours). They must also exhibit ultra-violet stability and have an index of refraction that substantially matches the index of refraction of the glass faceplate and implosion panel.

The preferred composition of the outer layer 28 includes the following acrylates:

(a) 40 to 90% by weight multifunctional urethane acrylate oligomer, such as urethane polyester acrylate;

(b) 10 to 55% by weight monofunctional acrylic monomer, including 0 to 30% by weight caprolactone acrylate, 0 to 30% by weight isobornyl acrylate, and 0 to 30% by weight methoxy hexanediol acrylate;

(c) 0 to 20% by weight difunctional acrylic monomer; and (d) 0 to 10% by weight trifunctional acrylic monomer.

The preferred composition of the inner layer 30 includes the following acrylates:

(a) 30 to 70% by weight multifunctional urethane acrylate oligomer, such as urethane polyester acrylate;

(b) 15 to 55% by weight monofunctional acrylic monomer, including 0 to 30% caprolactone acrylate, and 0 to 25% by weight isobornyl acrylate; and (c) 0 to 50% by weight difunctional acrylic monomer, including 0 to 25% by weight hexanediol diacrylate, and 0 to 25% by weight triethylene gylcol diacrylate;

(d) 0 to 40% by weight trifunctional acrylic monomer; and (e) 0.2 to 2% by weight of a releasing agent, such as a surfactant.

The above resin compositions also have added thereto various photo-initiators and neutral density filtering means as described below.

In accordance with this invention, a neutral density filtering agent in the form of about 1% by weight of a solution of an organic dye in a resin-reactive organic solvent is added to the outer layer 28 only. About 1% of the solution by weight is solute. "ORASOL BLACK CN" from Ciby-Geigy Corp. is a preferred organic dye, and "VPRC" brand of N-vinyl-2-pyrrolidone monomer from GAF Corp. is a preferred solvent.

While many combinations of materials can be used which exhibit the required properties, some actual examples are as follows:

The following Table I illustrates three examples of preferred compositions for the outer resin layer 28. The percentages are by weight.

TABLE I

| | Outer Resin Layer 28 | | |
|---|---|---|---|
| Ingredient | Example 1 | Example 2 | Example 3 |
| 893 | 67.5% | 56% | 60.05% |
| PH8017 | 7.45% | none | none |
| M-100 | none | 14% | 18% |
| IBA | 22.5% | 17.45% | 20% |
| QM920 | none | 10% | none |
| 907 | 0.5% | 0.5% | 0.5% |
| ITX | 0.05% | 0.05% | 0.05% |
| 1% Black CN in VPRC | 1% | 1% | 0.9% |
| T328 | 1% | 1% | 0.5% |

The following Table II illustrates three examples of preferred compositions for the inner resin layer 30. The percentages are by weight.

TABLE II

| | Inner Resin Layer 30 | | |
|---|---|---|---|
| Ingredient | Example 4 | Example 5 | Example 6 |
| 893 | 49% | 60.75% | 49% |
| M-100 | 28.45% | 15% | 28.45% |
| HDODA | 20% | none | none |
| SR272 | none | none | 20% |
| DC193 | 1.5% | 1% | 1.5% |
| IBA | none | 22.5% | none |
| 907 | 1% | 0.7% | 1% |
| ITX | 0.05% | 0.05% | 0.05% |

In the above Tables I and II the ingredients are as follows:

893 is UVITHANE 893, a polyester urethane acrylate oligomer sold by Morton Thiokol, Inc.

PH8017 is PHOTOMER 8017, a methoxy hexanediol acrylate sold by Diamond Shamrock Chemical Company.

M-100 is Tone M-100, a caprolactone acrylate monomer sold by Union Carbide Corporation.

IBA is isobornyl acrylate sold by Alcolac, Inc. and also by Arco Chemical Corporation.

HDODA is 1,6 hexanediol diacrylate sold by Arco Chemical Company and also by Interez, Inc.

SR272 is triethylene glycol diacrylate sold by Arco Chemical Company.

QM920 is a trifunctional acrylic monomer sold by Rohm & Haas Company.

DC193 is DOW CORNING 193, a urethane-compatible surfactant sold by Dow Corning, used as a releasing agent.

907 is Irgacure 907, a photo-initiator sold by Ciba-Geigy Corp.

ITX is 2-isopropyl thioxanthone from Aceto Chemical Co., Inc., a photo-initiator.

T328 is Tinuvin 328 from Ciba-Geigy Corp., an ultraviolet absorber which prevents fading of Black CN.

Black CN is Orasol Black CN, an organic dye from Ciba-Geigy Corp.

VPRC is N-vinyl-2-pyrrolidone monomer, a reactive organic solvent for Black CN, from GAF Corp.

The photo-initiators Irgacure 907 and ITX act synergistically to activate the curing of the resin at UV wavelengths above 400 nm. Upon exposure to UV wavelengths below 40 nm the dye is labile. Therefore, Tinuvin 328 is added to absorb those UV wavelengths and protect the dye, and curing is carried out entirely at longer wavelengths.

A preferred embodiment of the resin system 14 is an outer resin layer 28 with the formulation of Example 1 and an inner resin layer 30 having the formulation of either Example 4 or 5. All the formulations described herein work equally well, but they differ as to cost and viscosity. The less viscous formulations can be applied more easily in production.

Bonding of the implosion panel 12 to the faceplate 10 with the double layer resin bonding system of this invention can be achieved in several ways. One method begins with the application of a liquid release layer to a piece of "dummy" glass (a glass panel that will not become part of the CRT 20). The release layer may consist of 5% DC193 by weight dissolved in isopropyl alcohol.

Next, the resin layer 28 is applied in liquid form over the release layer. The implosion panel 12 is then placed on top of the dummy glass in contact with the resin layer 28, with the release layer between the resin layer and the dummy glass. The resin layer 28 is then cured by exposure to ultra-violet light from both sides using a Fusion Systems AEL-1B unit with a V type bulb at an exposure distance of about 13 inches for about 45 seconds from the implosion panel side. After curing, the resin layer 28 adheres strongly to the inner surface of the implosion panel 12.

Next, the dummy glass is removed with the aid of the DC193 release layer. This can be done by inserting a wedge, such as a razor blade, around the edges and then pulling the dummy glass away.

Then, the second resin layer 30 in liquid form is spread over the faceplate 10. The implosion panel with the cured resin layer 28 thereon is placed over the faceplate with the cured resin layer 28 in contact with the liquid resin layer 30. The resin layer 30 is then cured using the Fusion Systems AEL-1B unit with a V-type bulb at an exposure distance of about thirteen inches for about 45 seconds from the implosion panel side. The resin layer 30 then adheres to the resin layer 28, and also adheres relatively weakly to the faceplate 10. The bond with the faceplate is sufficient to retain the implosion panel on the faceplate through normal use, packaging and handling of the CRT, but not sufficient to maintain adhesion to the faceplate if the latter is deflected inwardly due to an impact.

Any UV exposures which are made of or through a tinted resin layer (such as, a resin layer containing Orasol Black CN in the above examples) should be made with Fusion Systems V-type bulbs instead of the D-type bulb employed in the parent application cited above, since the Tinuvin T328 UV absorber used herein will absorb too much of the short UV wavelengths emitted by the latter bulb. The V-type bulb has a longer wavelength spectral characteristic, and thus is more efficient when used in connection with the present tinted resin system.

A significant advantage of the present invention is that the tinted pigmented layer 28 can be made absolutely flat. Because the faceplate of a flat tension mask tube does not have a convex dome configuration as does a conventional faceplate, it yields slightly to external air pressure, which can generate forces of the order of 2000 pounds over a normal size tube face of less than 140 sq. inches. This has the effect of deflecting the nominally flat faceplate slightly inwardly, so that it is actually somewhat concave. As a result, if the tinted layer 28 were deposited on the faceplate 10 it would "pool" in the concavity and be of non-uniform thickness, i.e., thicker in the central region, and that non-uniformity will result in a neutral density gradient across the picture tube; i.e. the center of the display will be visibly darker than the edges. The faceplate 10 can also have various non-uniform irregularities and press marks if it is not polished, and this can result in a mottled effect. Both effects are undesirable. But when the tinted layer 28 is deposited on the flat, polished surface of the window glass implosion panel 12, the tint is distributed uniformly and there is no darkness gradient or mottling to mar the picture displayed on the CRT.

The UV-curable resins used in this invention cure in a matter of seconds, instead of several minutes or hours as in the case of prior art implosion panel bonding resin materials, which are all cured by heat or chemical curing agents. In particular, UV-curable resins do not require the admixture of chemical curing agents, as epoxy resins do. In addition UV-curable resin trapped inside the dispensing equipment does not need to be flushed out after a shut-down. Also, it is stable for many months at room temperature, which simplifies the storage of raw materials for production. UV-curable resins are also available in a wider range of viscosities, which offers more flexibility in choosing resin formulations to match production requirements. These resins also have the advantage of closely matching the index of refraction of glass, so as to minimize reflections from the glass-resin interfaces and thus avoid image-degrading reflection of ambient light and image light.

It will now be appreciated that such a system utilizing a dye-impregnated resin system to bond an implosion panel to a CRT faceplate darkens the faceplate and thus enhances the contrast of the CRT image displayed thereon. While the invention is of particular importance in connection with modern flat tension mask tubes of the kind described, it will also function in a conventional convex faceplate environment and therefore is not limited to use with flat-faceplate cathode ray tubes.

Still other embodiments of the principles of this invention are contemplated, and the appended claims are intended to cover such other embodiments as are within the spirit and scope of this invention.

The claimed invention is:

1. An evacuated display device comprising a faceplate member, an implosion protection panel member, and an adhesive system bonding said panel to said faceplate, composed and adapted to adhere substantially more strongly to one of said members than to the other, and incorporating contrast-enhancing light-absorptive means.

2. An evacuated display device comprising a brittle faceplate, an implosion protection panel, and an adhesive system bonding said panel to said faceplate, composed and adapted to adhere substantially more strongly to said panel than to said faceplate, and incorporating contrast-enhancing light-absorptive means.

3. An evacuated display device comprising a brittle faceplate, an implosion protection panel, and an adhesive system bonding said panel to said faceplate, said adhesive system comprising at least two layers of adhesive material adhered to each other, a first one of said layers being adhered to said faceplate, and a second one of said layers being adhered to said panel and composed and arranged to adhere substantially more strongly to said panel than said first layer adheres to said faceplate, said second layer incorporating contrast-enhancing light-absorptive means.

4. An evacuated display device comprising a brittle faceplate, an implosion protection panel, and an adhesive system bonding said panel to said faceplate, said adhesive system comprising at least two layers of adhesive material adhered to each other, an inner one of said layers being adhered to said faceplate, and an outer one of said layers being adhered to said panel and composed and adapted to adhere substantially more strongly to said panel and to said inner layer than said inner layer adheres to said faceplate, said outer layer incorporating contrast-enhancing light-absorptive means.

5. An evacuated display device comprising a brittle faceplate, an implosion protection panel, and an adhesive system bonding said panel to said faceplate, said adhesive system comprising at least one layer of adhesive material adhered to said panel and a release layer between said adhesive layer and said faceplate, said layer of adhesive material incorporating contrast-enhancing light-absorptive means.

6. An evacuated display device comprising a relatively non-epoxy thick and less flexible brittle faceplate member, a relatively thin and more flexible implosion protection panel member, and an non-epoxy adhesive system bonding said panel to said faceplate and composed and adapted to adhere substantially more strongly to one of said members than to the other, said adhesive system incorporating neutral density contrast-enhancing light-absorptive means.

7. The device defined by claims 1, 2, 3, 4, 5 or 6 wherein said adhesive system includes a UV-curable resin layer.

8. An evacuated display device comprising a brittle faceplate member, an implosion protection panel member, and at least one layer of UV-curable non-epoxy adhesive material bonding said panel to said faceplate and composed and adapted to adhere substantially more strongly to one of said members than to the other, said adhesive material incorporating neutral density contrast-enhancing light-absorptive means.

9. A cathode ray tube comprising a faceplate and an implosion panel bonded to said faceplate by UV-curable non-epoxy adhesive incorporating neutral density contrast-enhancing light-absorptive means.

10. An evacuated display device comprising a faceplate member, an implosion protection panel member, and a non-epoxy adhesive system bonding said panel to said faceplate, composed and adapted to adhere substantially more strongly to one of said members than to the other, and incorporating a solution of an organic dye in a solvent.

11. The device of claim 10 wherein the organic dye is a mono-azo metal complex dyestuff.

12. A cathode ray tube comprising:

an implosion panel having an inner surface;

a first resin layer bonded to the inner surface of said implosion panel and having a composition comprising the following esters in percentages by weight:

(a) 40 to 90% multifunctional urethane acrylate oligomer;

(b) 10 to 55% monofunctional acrylic monomer, including:
0 to 30% caprolactone acrylate,
10 to 30% isobornyl acrylate, and
0 to 30% methoxy hexanedoil acrylate;

(c) 0 to 20% difunctional acrylic monomer;

(d) 0 to 10% trifunctional acrylic monomer; and (e) about 1% of a 1% solution of an organic dye in a solvent;

a faceplate having an outer surface, a second resin layer bonded to the outer surface of said faceplate, and having a composition comprising the following esters in percentages by weight;

(a) 30 to 70% multifunctional urethane acrylate oligomer;

(b) 15 to 55% monofunctional acrylic monomer, including
0 to 30% caprolactone acrylate, and
0 to 25% isobornyl acrylate; and (c) 0 to 50% difunctional acrylic monomer, including
0 to 30% hexanediol diacrylate, and
0 to 20% triethylene glycol diacrylate;

(d) 0 to 40% trifunctional acrylic monomer; and (e) 0.2 to 2% releasing agent; said implosion panel being bonded to said faceplate by means of said first and second resin layers.

13. A cathode ray tube comprising a faceplate, an implosion panel thereover, a non-epoxy adhesive securing said implosion panel to said faceplate, and a soluble organic dye of a mono-azo metal complex incorporated into said adhesive to provide said adhesive with neutral density and contrast enhancing properties.

14. An evacuated display device comprising a faceplate member, an implosion protection member and an adhesive system bonding said panel to said faceplate, said adhesive system comprising a non-epoxy resin which is curable by exposure to ultra-violet and a solution of a neutral density contrast-enhancing soluble organic dye in a solvent that is chemically reactive with said resin.

15. The device defined in claim 14 wherein said ultraviolet-curable resin comprises the following esters in percentages by weight:

(a) 40 to 90% multifunctional urethane acrylate oligomer;

(b) 10 to 55% monofunctional acrylic monomer, including:
0 to 30% caprolactone acrylate,
10 to 30% isobornyl acrylate, and
0 to 30% methoxy hexanedoil acrylate;

(c) 0 to 20% difunctional acrylic monomer;

(d) 0 to 10% trifunctional acrylic monomer; and (e) about 1% of a 1% solution of an organc dye in said solvent.

16. The device defined in claim 15 wherein said solvent is N-vinyl-2-pyrrolidone monomer.

17. The device defined in claim 16 wherein said dye is organic.

18. The device defined in claim 17 where said organic dye is mono-azo metal complex dyestuff.

19. A method of manufacturing a cathode ray tube having a faceplate and an implosion panel thereover comprising the steps of:

interposing an ultraviolet-curable non-epoxy adhesive material incorporating neutral density contrast-enhancing light-absorptive means between said implosion panel and said faceplate;

and curing said adhesive material by exposure to ultraviolet radiation to bond said implosion panel to said faceplate.

20. A method of manufacturing a cathode ray tube having a faceplate and an implosion panel thereover comprising the steps of:

interposing a non-epoxy adhesive material incorporating neutral density contrast-enhancing light-absorptive means between said implosion panel and said faceplate;

and curing said adhesive material to bond said implosion panel to said faceplate;

said adhesive material being characterized by having different adhesive qualities relative to said faceplate and said implosion panel respectively.

21. A method of manufacturing a cathode ray tube having a faceplate and an implosion panel thereover comprising the steps of:

applying ultraviolet-curable non-epoxy adhesive material incorporating contrast-enhancing light-absorptive means to said implosion panel and to said faceplate;

and ultraviolet-curing said adhesive material to provide a bond between said implosion panel and said faceplate.

22. A method of manufacturing a cathode ray tube having a nominally flat faceplate and a substantially flatter implosion panel thereover, comprising the steps of:

applying a first ultraviolet-curable adhesive composition incorporating contrast-enhancing light-absorptive means to said implosion panel;

applying a second ultraviolet-curable adhesive composition to said faceplate;

and ultraviolet-curing the first and second adhesive compositions to provide adhesion between each of said adhesive compositions and between said first adhesive composition and said implosion panel and between said second adhesive composition and said faceplate.

23. A method as in claim 22 wherein said second adhesive composition has a lower level of adhesion to said faceplate than said first adhesive composition has to said implosion panel.

24. A method as in claim 12 wherein said ultra-violet curing step is carried out by means of an ultra-violet illumination source which has a spectral peak not coinciding with the absorption peak of said light-adsorptive means.

25. The cathode ray tube of claim 12 wherein the faceplate and inplosion panel are substantially flat and the first resin layer, and said organic dye is neutral density contrast-enhancing.

26. The cathode ray tube of claim 25 wherein the first resin layer is 67.5% of a polyester urethane acrylate polymer;
7.45% methoxy hexanediol acrylate;
22.5% isobornyl acrylate;
0.5% photo-initiator;
0.05% 2 -isopropyl thioxanthone;
1.0% mono-azo metal complex neutral; density contrast enhancing dye;
1.0% ultra-violet absorber.

27. The cathode ray tube of claim 26 wherein the second resin layer is

49% of a polyester urethane acrylate polymer;
28.45% a caprolactone acrylate monomer;
20% 1, 6 hexanediol diacrylate;
1.5% a urethane-compatible surfactant;
1.0% photo-initiator;
0.05% 2-isopropyl thioxanthone.

28. The cathode ray tube of claim 26 wherein the second resin is 60.75% of a polyester urethane acrylate polymer;
28.45% a caprolactone acrylate monomer;
20% 1, 6 hexanediol diacrylate;
1.5% a urethane-compatible surfactant;
1.0% photo-initiator;
0.05% 2-isopropyl thioxanthone.

29. In a cathode ray tube having a nominally flat faceplate which is, due to its flat configuration, deflected inwardly when the tube is evacuated, thus predisposing it to extremely violent implosion upon fracturing of the faceplate, a contrast-enhancing implosion system comprising:

a transparent implosion panel having a rear surface which is substantially flatter than, and juxtaposed to, said front surface of said faceplate;

and a transparent adhesion system between said front surface of said faceplate and said rear surface of said implosion panel for bonding said panel to said faceplate;

said adhesion system being relatively strongly adhered . to said rear surface of said implosion panel and relatively weakly adhered to said front surface of said faceplate;

said adhesion system including light-absorptive means for enhancing the contrast of images formed by said cathode ray tube.

* * * * *